United States Patent [19]

Herbst et al.

[11] 3,970,023

[45] July 20, 1976

[54] TOOLING ARRANGEMENT FOR END CLOSURE SCORING

[75] Inventors: Edward J. Herbst, Posen; Harry A. Peyser, Olympia Fields, both of Ill.

[73] Assignee: Continental Can Company, Inc., New York, N.Y.

[22] Filed: Apr. 25, 1975

[21] Appl. No.: 571,450

[52] U.S. Cl. ..... 113/1 F; 113/15 A; 113/80 DA

[51] Int. Cl.[2] ..... B21D 51/26; B21D 51/46

[58] Field of Search ..... 113/1 F, 15 A, 80 DA, 113/121 A, 121 C; 220/266, 268–273, 359

[56] References Cited

UNITED STATES PATENTS

| | | | |
|---|---|---|---|
| 3,338,199 | 8/1967 | Taylor | 113/15 A |
| 3,359,773 | 12/1967 | Stuchbery | 72/325 |
| 3,688,718 | 9/1972 | Schrecker | 113/15 A |
| 3,868,919 | 3/1975 | Schrecker et al. | 113/121 C |
| 3,875,884 | 4/1975 | Zundel | 113/15 A |

FOREIGN PATENTS OR APPLICATIONS

| | | | |
|---|---|---|---|
| 22,359 | 5/1907 | Sweden | 113/15 A |

*Primary Examiner*—Lowell A. Larson
*Assistant Examiner*—E. M. Combs
*Attorney, Agent, or Firm*—John J. Kowalik; Joseph E. Kerwin; William A. Dittmann

[57] ABSTRACT

An improved tooling configuration enables production of an end panel opening score line without loss of the enamel protective coating on the reverse side of the end panel. Current scoring methods frequently result in enamel loss, and hence, necessitate coating repair before the end panel may be attached to the can body. By controlling the angular relationship of the score punch and anvil, while simultaneously confining the displaced metal, the enamel which was previously applied to the panel is retained substantially in place with only a slight reduction in thickness. Punch angles of 90° – 100° and anvil angles of 25° – 35° have been found to be effective, with a punch angle of 90° and an anvil angle of 30° being optimum. The metal may best be confined and controlled by the simultaneous formation of an anti-fracture score concentric with, and radially inward of the opening score line.

8 Claims, 4 Drawing Figures

TOOLING ARRANGEMENT FOR END CLOSURE SCORING

SUMMARY OF THE INVENTION

The present invention relates generally to an easy-opening metal can and, more particularly to the formation of the opening score line.

Currently, metal cans for packaging of foodstuffs, soft drinks, beer and the like are produced with an enamel coating covering the interior surfaces of the container. This coating protects the metal can walls from possibly corrosive effect of the container contents. However, current scoring methods frequently result in enamel loss and, hence, necessitate coating repair before the end panel may be attached to the can body.

It is, therefore, the primary object of the present invention to provide a means of forming the opening score line without loss of the enamel protective coating on the reverse side of the end panel. This is accomplished by controlling the angular relationship of the score punch and anvil, while simultaneously confining the flow of metal displaced by the score line formation.

It is a further object to provide an improved means of score line formation which is inexpensive and compatible with existing production equipment.

DESCRIPTION OF THE DRAWINGS

The various features and advantages of the improved score line tooling arrangement of this invention will be more apparent from the following detailed description when considered in connection with the accompanying drawing wherein.

DESCRIPTION OF THE PREFERRED EMBODIMENT

Figure 1:
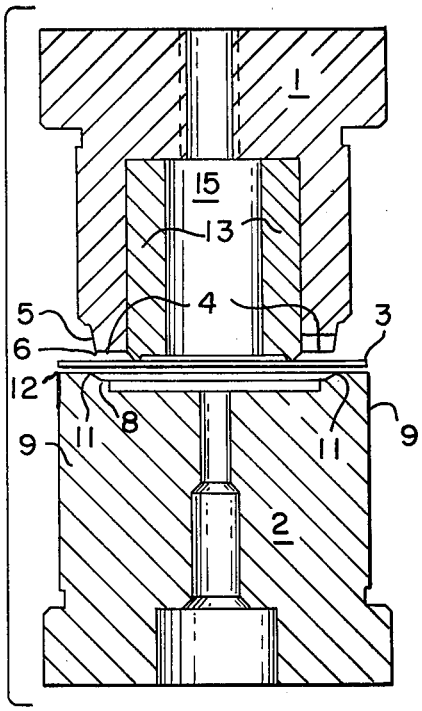
FIG. 1 is a cross-sectional view of the punch and anvil used to create the score.
Figure 2:
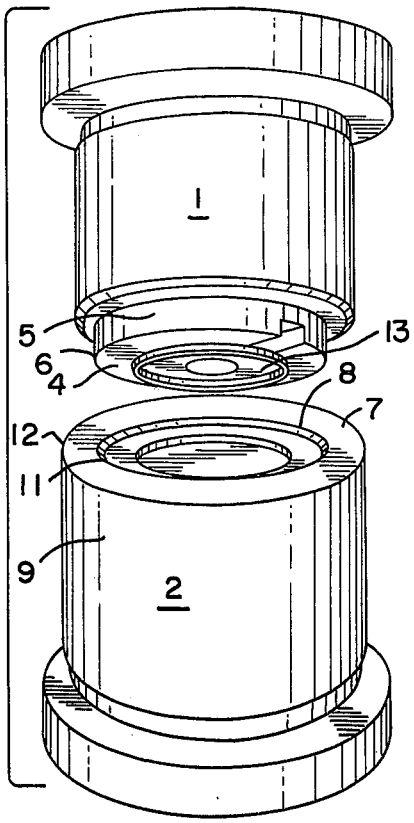
FIG. 2 is a side perspective view of the tooling shown in FIG. 1.

The improved tooling arrangement of the present invention comprises a punch 1 and an anvil 2 between which a sheet metal blank 3 may be positioned to have a score line 10 formed therein. The punch 1 has a flat, substantially horizontal bottom face 4 and a lateral outer face 5 which meet at a relatively sharp corner 6 in order that a similar sharp corner will be formed in the score line 10.

The anvil 2 has a flat, substantially horizontal top face 7, a lateral inner face 8 extending downwardly from the top face 7 and a substantially vertical side face also extending downwardly therefrom. The top face 7 meets both the inner face 8 and the side face 9 at relatively sharp corners 11 and 12 respectively.

Figure 3:
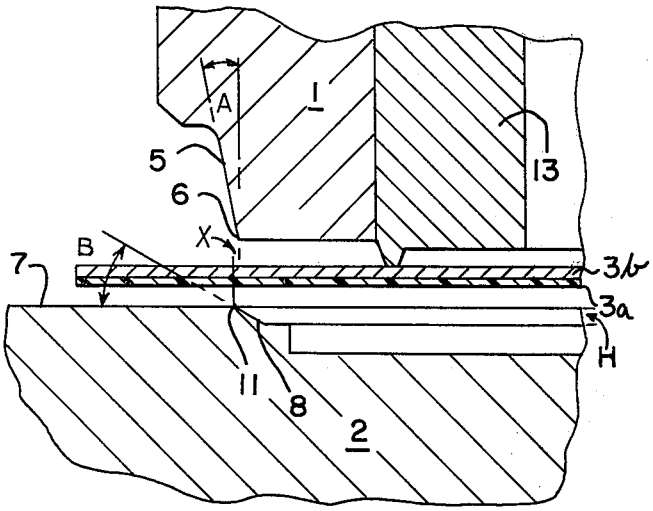
FIG. 3 is an enlarged, fragmental sectional view similar to FIG. 1.
Figure 4:
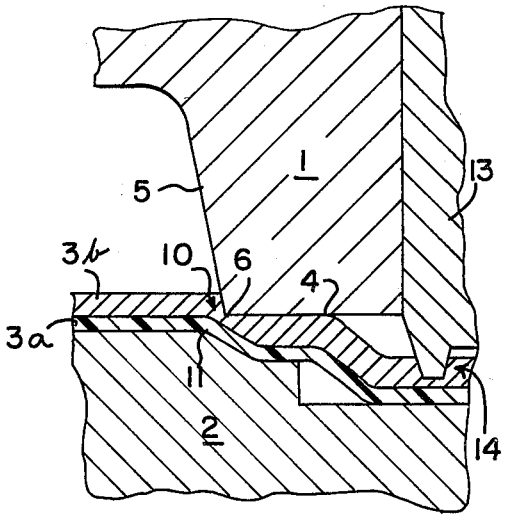
FIG. 4 is an enlarged fragmental sectional view similar to FIG. 3, illustrating the formation of the score line.

The lateral faces 5 and 8 overlap each other in a horizontal direction as indicated by the X dimension in FIG. 3.

As the punch 1 and the anvil 2 are moved together against the blank 3, metal is displaced by tool surfaces 4, 5, 7 and 8. Although the mechanism is not fully understood, it has been observed that retention of the enamel coat *3a* requires that metal displacement be along laminar streamlines parallel to the metal/enamel interface *3b* and that stretching of this interface *3b* be minimized. It has further been observed that these requirements can be met by controlling the angular relationship of the punch 1 and the anvil 2 while simultaneously confining the displaced metal. Specifically, punch angles A of 90°–110° and anvil angles B of 25°–35° have been found to be effective, with a punch angle A of 90° and an anvil angle B of 30° being optimum.

The metal confinement may be achieved by simultaneously forming an anti-fracture score line 14 when the opening score line 10 is being formed. The anti-fracture score line 14 is preferably formed concentric with, and radially inward of, the opening score line 10 by conventional tool member 13 held within a recess 15 in the center of the punch 1.

Experiments with 0.0130–0.0135 inch thick aluminum blanks indicate that an overlap (X) of 0.0020 inches and an anvil depth (H) of 0.0180 inches will yield an opening score line 10 with a 0.0023 inch residual thickness wherein the enamel coat *3a* on the reverse side of the blank remains substantially in place with only a slight reduction in thickness. The experiments further reveal that the depth of the anti-fracture score line 14 and the distance between the opening score line 10 and the anti-fracture score line 14 are not critical variables but, rather, may be chosen with a wide degree of latitude.

We claim:

1. An improved tooling configuration for production of an opening score line in a metal end panel of a can or similar container without fracturing an enamel coating previously applied to the panel, said tooling comprising a punch and an anvil for receiving a panel therebetween, said punch having a flat substantially horizontal bottom face and a lateral outer face, said anvil having a flat substantially horizontal top face, a lateral inner face depending from said top face and a side face depending from said lateral face, said outer face being inclined in the range of about 90° to about 110° relative to said bottom face, said lateral face being inclined in the range of about 25° to about 35° relative to said top face, said punch and said anvil meeting with said bottom face and said top face in substantially parallel relation and said outer face opposing said lateral face, whereby the movement of said punch into said panel against said anvil displaces a portion of the metal of said panel, thereby forming a score line therein without fracturing the enamel coating.

2. An improved tooling configuration as described in claim 1 wherein said tooling has forming means for forming an anti-fracture score concentric with said opening score line.

3. An improved tooling configuration as described in claim 2 wherein said anti-fracture score line forming means is radially inward of said opening score line forming means.

4. An improved tooling configuration as described in claim 1 wherein said punch and said anvil meet with said lateral face and said inner face in overlapping relation.

5. An improved tooling configuration as described in claim 4 wherein said bottom face and said outer face meet at a relatively sharp corner.

6. An improved tooling configuration as described in claim 5 wherein said top face and said inner face meet at a relatively sharp corner.

7. An improved tooling configuration as described in claim 6 wherein said outer face is inclined at substantially 90° relative to said bottom face.

8. An improved tooling configuration as described in claim 6 wherein said lateral face is inclined at substantially 30° relative to said top face.

* * * * *